US011823650B2

(12) United States Patent
Holcomb

(10) Patent No.: US 11,823,650 B2
(45) Date of Patent: Nov. 21, 2023

(54) ERGONOMIC PLECTRUM

(71) Applicant: Paul Holcomb, Inlet Beach, FL (US)

(72) Inventor: Paul Holcomb, Inlet Beach, FL (US)

( * ) Notice: Subject to any disclaimer, the term of this patent is extended or adjusted under 35 U.S.C. 154(b) by 43 days.

(21) Appl. No.: 17/715,879

(22) Filed: Apr. 7, 2022

(65) Prior Publication Data

US 2022/0328023 A1 Oct. 13, 2022

Related U.S. Application Data

(60) Provisional application No. 63/172,047, filed on Apr. 7, 2021.

(51) Int. Cl.
*G10D 3/173* (2020.01)

(52) U.S. Cl.
CPC ..... *G10D 3/173* (2020.02)

(58) Field of Classification Search
CPC ..... G10D 3/173; G10D 1/08; G10D 3/00; G10D 1/00
See application file for complete search history.

(56) References Cited

U.S. PATENT DOCUMENTS

| | | | | |
|---|---|---|---|---|
| 6,346,662 | B1 | 2/2002 | Sielaff | |
| 6,777,602 | B2 | 8/2004 | Hautamaki | |
| 7,238,869 | B1 | 7/2007 | Kleckzka | |
| 10,600,392 | B2 | 3/2020 | Holcomb | |
| 2017/0011720 | A1 | 1/2017 | Pascale | |
| 2017/0103737 | A1* | 4/2017 | Hierholzer | G10D 3/173 |

OTHER PUBLICATIONS https://bogstreet.com/pages/design; BOG STREET, ALL (Year: 2020).*

* cited by examiner

*Primary Examiner* — Kimberly R Lockett

(57) ABSTRACT

A plectrum for strumming a stringed instrument has a body having a front face, a rear face, a pick tip, and an outer edge. An ergonomic contour is provided on the front face or the rear face of the body. In one version, the ergonomic contour extends radially from a central region to a position short of the outer edge of the plectrum, wherein the ergonomic contour creates a surface that is contactable by a thumb or other finger of a user to assist the user in using the plectrum and wherein the ergonomic contour does not interfere with using the outer edge during strumming. In another version, the ergonomic contour provides a tactile indication of the position, location, or orientation of a pick tip. The ergonomic contour can be in the form of a ridge and/or a change of thickness of the central region.

20 Claims, 5 Drawing Sheets

ERGONOMIC PLECTRUM

PRIORITY

The present application claims the benefit of domestic priority based on U.S. Provisional Patent Application 63/172,047 filed on Apr. 7, 2021, the entirety of which is incorporated herein by reference.

BACKGROUND

Guitar playing is a time-honored tradition that dates back for generations. Much technology has gone into the design of the guitar, but relatively little has been developed in terms of the tools used to play a guitar.

Guitarists are some of the most vulnerable musicians to hand injuries. Repetitive strain injuries or injuries of the musculoskeletal and/or nervous systems caused by repetitive tasks, forceful exertions, vibrations, mechanical compression, or sustained or awkward positions are particularly prevalent for guitar players. Examples of common problems include nerve compression syndromes, such as carpel tunnel syndrome and cubital tunnel syndrome. Tendonitis or inflammation of the tendons is also common in the wrist of a guitar player. Other ailments include tennis elbow, focal dystonia, and arthritis. Surprisingly it is often the strumming hand rather than or in addition to the fret hand that develops the repetitive strain injuries.

A plectrum, also known as a pick, is a traditionally flat tool used to pluck or strum a stringed instrument. Playing a guitar with a plectrum produces a bright sound compared to plucking with the fingertip. Plectrums also offer a greater contrast in tone across different plucking locations. For these reasons and more, most guitar players prefer to use a plectrum when playing. Thus, the strumming hand of a guitar player is often holding a plectrum by squeezing it between the thumb and one or more other fingers while the hand is making a strumming motion. These muscular stresses and awkward movements together over time can lead to fatigue and/or injury of the hand, such as one or more of the injuries discussed above. In addition, because of the traditionally flat shape and thinness of conventional plectrums, they can easily rotate and slide on the fingers when being used. This potential movement can cause a user to have to squeeze tighter than optimal, and this squeezing can lead to injuries.

U.S. Pat. No. 10,600,392, which is incorporated herein by reference in its entirety, introduced the concept of an ergonomic plectrum. In particular, U.S. Pat. No. 10,600,392 teaches an ergonomic plectrum with a radially extending ergonomic contour on one or both sides of the plectrum, such as a radially extending protrusion. The prior ergonomic plectrum was ergonomically designed to have improved handleability in a manner that reduces rotation and slippage. In addition, the ergonomic plectrum reduces hand fatigue and reduces the likelihood of hand injury in a manner that reduces rotation and slippage. While successful in accomplishing its objective, there are certain aspects of the design of the prior ergonomic plectrum that can be improved upon.

There is therefore a need for an improved ergonomic plectrum that improves on the concepts introduced in the prior ergonomic plectrum. There is a further need for an ergonomic plectrum that can be played on either a tip or a side without encumbrance. There is a further need for an ergonomic plectrum that provides a tactile indication of a tip that is being used.

SUMMARY

The present invention satisfies these needs. In one aspect of the invention, an improved ergonomic plectrum is provided.

In another aspect of the invention, an ergonomic plectrum is provided that has an improved radially extending ergonomic contour or protrusion.

In another aspect of the invention, an ergonomic plectrum is provided that has an improved radially extending ergonomic contour or protrusion that is designed to allow for playing of a stringed instrument with either a tip of a side of the plectrum.

In another aspect of the invention, an ergonomic plectrum is provided that has an improved radially extending ergonomic contour or protrusion that is designed to allow for playing of a stringed instrument with either a tip of a side of the plectrum without encumbrance from the ergonomic contour.

In another aspect of the invention, an ergonomic plectrum is provided that has an improved radially extending ergonomic contour or protrusion designed to provide a tactile indication of a specific plectrum tip being used.

In another aspect of the invention, a plectrum for strumming a stringed instrument comprises a body having a front face, a rear face, a pick tip, and an outer edge, and an ergonomic contour on the front face or the rear face of the body, the ergonomic contour extending radially from a central region to a position short of the outer edge of the plectrum, wherein the ergonomic contour creates a surface that is contactable by a thumb or other finger of a user to assist the user in using the plectrum and wherein the ergonomic contour does not interfere with using the outer edge during strumming.

In another aspect of the invention, a plectrum for strumming a stringed instrument comprises a body having a front face, a rear face, a central region, a first pick tip, and a second pick tip, the first pick tip being different than the second pick tip, and an ergonomic contour on the front face or the rear face of the body, the ergonomic contour creating a surface that is contactable by a thumb or other finger of a user to assist the user in using the plectrum, and wherein the ergonomic contour comprises a ridge that extends orthogonally to a bisector of the first pick tip whereby a user can use the ridge as a tactile indication of the position of the first pick tip.

In another aspect of the invention, a plectrum for strumming a stringed instrument comprises a body having a front face, a rear face, a central region, a first pick tip, and a second pick tip, the first pick tip being different than the second pick tip, and an ergonomic contour on the front face or the rear face of the body, the ergonomic contour creating a surface that is contactable by a thumb or other finger of a user to assist the user in using the plectrum, and wherein the ergonomic contour comprises a change in thickness of the central region, the change in thickness including a less thick portion that allows a user to get a tactile indication of the first pick tip.

In another aspect of the invention, a method of using a plectrum comprises grasping the plectrum and receiving a tactile indication of the position, location, and/or orientation of a pick tip.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to a plectrum for strumming strings of a stringed instrument. Although the plectrum is illustrated and described in some instances in the context of being useful as a guitar pick, the present invention can be useful in other instances. Accordingly, the present invention is not intended to be limited to the examples and embodiments described herein.

Figure 1A:
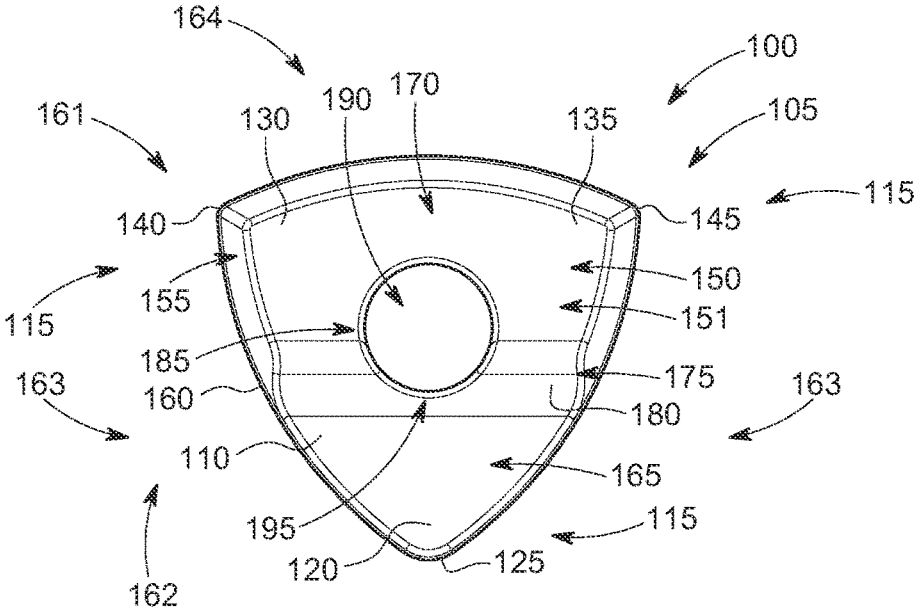
FIG. 1A is a schematic front view of a plectrum according to the invention.
Figure 1B:
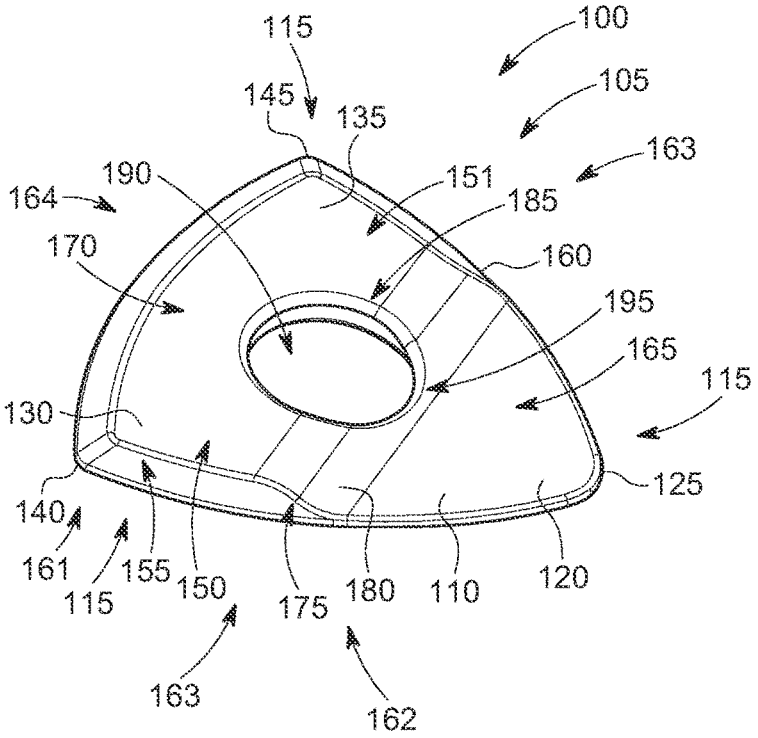
FIG. 1B is a schematic perspective side view of the plectrum of FIG. 1A.
Figure 1C:
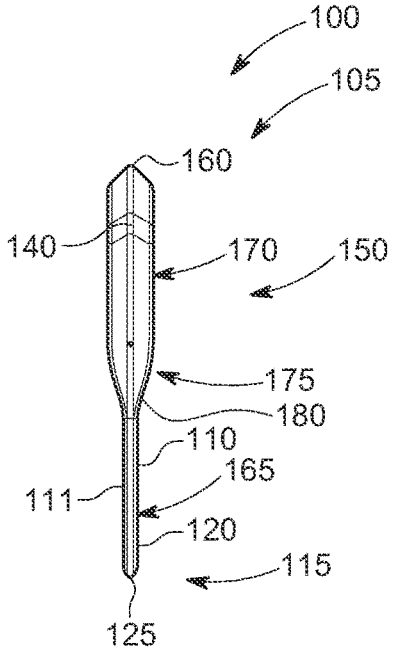
FIG. 1C is a schematic side view of the plectrum of FIG. 1A.

FIG. 1A through 1C show a plectrum 100 according to the invention. The plectrum has a body 105 having a front face 110 as seen in FIG. 1A and a rear face 111 as seen in FIG. 1C. The plectrum 100, also known as a pick, is grasped by a user and is used to strum a stringed instrument, such as a guitar, mandolin, banjo, bass guitar, and the like. A plectrum 100, such as the one shown, that is specifically designed for a guitar is often referred to as a guitar pick or guitar plectrum. In the version of FIG. 1A, the body 105 of the plectrum 100 has one or more angled corner portions 115. At least one of the angled corner portions 115 forms a first pick tip 120 having an edge 125 that can be used to contact the strings of a stringed instrument and to strum or pluck one or more of the stings to make music. In the version shown, the body 105 of the plectrum also includes additional pick tips, such as a second pick tip 130 and a third pick tip 135 with first edge 140 and second edge 145, respectively. A user grasps the plectrum 100 by contacting the front face 110 with the user's thumb and a rear face 111 with a user's finger, such as an index finger and/or middle finger, or vise-versa. The plectrum 100 is thus squeezed between the user's thumb and finger in such a way that a desired portion of the plectrum 100, such as the first pick tip 120 and its associated edge 125, is positioned so that it may contact the strings of the stringed instrument.

The plectrum 100 may be gripped and manipulated in any of numerous manners. For example, the plectrum 100 may be gripped with two fingers, such as the thumb and the index finger or the thumb and the middle finger. Alternatively, the plectrum may be gripped with three fingers, such as the thumb, the index finger, and the middle finger. The motion of the plectrum 100 against the strings of the stringed instrument also can vary from user to user. For example, a user may hold the plectrum very stiffly between the thumb and index finger, locking the thumb joint and striking with the surface of the pick nearly parallel to the string. Alternatively, a user may use a technique where the thumb joint is bent on the downstroke and straightened on the upstroke, causing the tip of the pick to move in a circular pattern, which can allow speed and fluidity.

The plectrum 100 according to the invention can have any size and shape suitable for being used as a plectrum. For example, the plectrum 100 can be generally round, circular, oval, ovate, triangular, trianguloid, square, rectangular, or other polygonal shape. In the version shown, the plectrum 100 has a general triangular or trianguloid shape. By trianguloid it is meant that the overall shape of the plectrum when viewing from the front and/or rear has a general triangular shape in that there are three clearly defined corners and three clearly defined sides connecting the corners, but the corners need not necessarily be points and the sides need not necessarily be perfectly straight and/or continuous. The plectrum 100 can have any suitable thickness. For example, in one version, the plectrum 100 has a thickness that ranges from about 0.3 mm to about 10 mm and in another version from about 0.6 mm to about 4 mm. As will be discussed, the thickness can vary across the face of the plectrum. In one version, the plectrum 100 has a length dimension of from about 20 mm to about 50 mm and in another version from about 25 mm to about 38 mm. For a circular plectrum, the length dimension can be the diameter of the circular shape. For other shapes, the length dimension can be either the longest dimension in the general plane of the plectrum that passes through the center of the plectrum and/or the shortest dimension on the general plane of the plectrum that passes through the center of the plectrum.

The plectrum 100 may be provided with an ergonomic contour 150 on its front face 110 and/or its rear face 111. The ergonomic contour 150 is a projection and/or recess arising from or extending into the front face 110 and/or the rear face 111. The ergonomic contour 150 creates a surface that is contactable by the thumb and/or fingers of the user when playing the plectrum 100. The shape of the ergonomic contour 150 can be designed to facilitate gripping and handling of the plectrum 100 in an advantageous manner and/or can be designed to provide a tactile indication of condition or orientation of the plectrum 100 and/or can be designed to accomplish any other touch or handling objective. In the version of FIGS. 1A through 1C, the ergonomic contour is a radially extending ergonomic contour 151. By radially extending, it is meant that the ergonomic contour extends from the center of the plectrum 100 or from a central region of the plectrum 100 towards one or more tips and/or sides. The term radial is, of course, not intended to suggest that the plectrum 100 must be circular in shape and may be applied, for example, to the trianguloid shape of the plectrum 100 of FIGS. 1A through 1C.

In one version, the ergonomic contour 150 includes a radial outer extent 155 that terminates radially short of a peripheral outer edge 160 of the plectrum 100. By having the ergonomic contour 150 terminate short of the outer edge 160 of the plectrum, whether that be a pick tip portion 161 of the outer edge 160 or the side portion 162 of the outer edge 160, the outer edge 160 can be used to strum a stringed instrument. This presents a significant advantage over any previous ergonomic plectrum when an ergonomic contour extended to or beyond the outer edge of the plectrum. In that case, only the portion of the outer edge of the plectrum that was not near the ergonomic contour could most effectively be used to strum a stringed instrument. In contrast, with the plectrum 100 of the present invention as and embodied in FIGS. 1A through 1C, a user can use the first pick tip 120 which is not near the ergonomic contour 150 and can, if desired, use the second pick tip 130 or the third pick tip 135 which are near the ergonomic contour 150. In addition, sometimes it is desirable for a user to use the side portion 162 outer edge 160 to play the instrument to create a different sound. With the plectrum 100 of FIG. 1A through 1C, the ergonomic contour 150 does not obstruct such side edge playing. In addition, in the particular version and configuration of the plectrum 100 of FIGS. 1A through 1C, two of the sides 163 of the plectrum 100 have a portion that includes the ergonomic contour 150 and a portion that includes no ergonomic contour, and one of the side 164 entirely has the ergonomic contour 150. This allows for even more variability of sound that can be generation thus giving the user even more sound-creation options.

Also, in the specific ergonomic contour 150 of the version of FIGS. 1A through 1C, the radially extending ergonomic contour 150 creates a first region 165 of the plectrum 100 having a first thickness and a second region 170 of the plectrum 100 having a second thickness. In the version show, the first thickness is less than the second thickness. However, this can be reversed. As can be seen, the first region 165 includes the first pick tip 120, and the second region 170 includes the second pick tip 130 and the third pick tip 135. In another version, three or more regions, each having a different thickness, can be provided with each region including a different pick tip.

The ergonomic contour 150 of the plectrum 100 can also include a tactile indicator 175 that can be felt by a user and used to inform the user of information concerning the use or orientation of the plectrum 100. For example, in the version of FIGS. 1A through 1C, the tactile indicator 175 can be provided by the thickness change associated with the ergonomic contour 150. The change in thicknesses between the first region creates a ridge 180 or slope that can be easily felt or detected by a user holding the plectrum 100. In this particular version, the ridge 180 is designed to be oriented in a manner that communicates to the user the location of the first pick tip 120. For example, the ridge 180 can be arranged to run generally orthogonal to a line generally bisecting the first pick tip 120. Thus, when a user feels the ridge 180, the user knows precisely which of the pick tips is the first pick tip 120, for example which one of the picks has the smaller thickness in the version of FIGS. 1A through 1C.

The plectrum 100 of the present invention and as shown in the version of FIGS. 1A through 1C can also include a central region 185. The central region 185 includes the geometric center of the front face 110 of the plectrum 100 and extends radially from the geometric center towards the pick tips and/or sides of the plectrum 100. The central region 185 can, for example, extend from the geometric center to a radial position that is from at least about 10 percent to about 70 percent of the distance from the geometric center to the outer edge of a tip and/or a side of the plectrum 100. In one version, the central region 185 can, for example, extend from the geometric center to a radial position that is from at least about 20 percent to about 30 percent of the distance from the geometric center to the outer edge of a tip and/or from about 30 percent to about 40 percent of the distance from the geometric center to the outer edge of a side a side of the plectrum 100. And in the particular version of FIGS. 1A through 1C, the central region 185 can, for example, extend from the geometric center to a radial position that is about 27 percent of the distance from the geometric center to the outer edge of a tip and/or about 37 percent of the distance from the geometric center to the outer edge of a side a side of the plectrum 100. The central region 185 can be circular, as shown in FIGS. 1A through 1C or can be any other geometric shape. For example, in one version, the central region 185 can be trianguloid. The central region 185 can be an opening 190 that extends through the body 105 of the plectrum 100 from the front face 110 to the rear face 111. Alternatively, the central region 185 can be a depression that extends into the front face 110 and/or the rear face 111 without extending all the way through the body 105. Alternatively still, the central region 185 can be sized and shaped to be like the rest of the front face 110 and/or rear face 110 of the plectrum 100 and not have any noticeable demarcations other than the dimensional features discussed above.

In the version of FIGS. 1A through 1C, the ergonomic contour 150 is designed so that only a portion of the central region 185 includes the ergonomic contour 150. In other words, for the version of FIGS. 1A though 1C, the central region 185 includes both the first region 165 and the second region 170 and has a non-uniform thickness around its periphery, which may be a circular periphery or other shape. In the particular version shown, this is accomplished by having the ridge 180 of the tactile indicator 175 pass through the central region 185. In this manner, the central region 185 has an orientation portion 195 that has the thickness of the first region 165 whereas the rest of the central region 185 has a thickness associated with the second region 170. This divides the ridge 180 into two portions that are separated by the orientation portion 195 of the central region 185. The orientation portion 195 of the central region 185 is aligned directly with the first pick tip 120. Accordingly, a user is easily able to feel the ridge 180 and the orientation portion 195 and thus know precisely where the first pick tip 120 is without having to look. The ridge 180 can intersect the central region 185 at any position of the central region that allows the orientation portion 195 to provide tactile information to the user. In the version shown, the orientation portion 195 is created by having the ridge 180, which is orthogonal to the first pick tip bisector, intersect the central portion 185 at a position between the geometric center of the plectrum 100 and at the portion of the central region 185 nearest to the first pick tip 120. In the version of FIGS. 1A through 1C, the ridge 180, which is orthogonal to the first pick tip bisector, intersects the central portion 185 at a position approximately halfway between the geometric center of the plectrum 100 and at the portion of the central region 185 nearest to the first pick tip 120. This creates an arc of the central region 185 that makes up the orientation portion 195 which extends less than 180 degrees of the central region 185. In particular versions, the arc can extend from about 30 degrees to about 150 degrees of the central region 185.

The dimensions of the plectrum 100 can be selected to have any desired size and shape to produce a desired tone or sound for a user's preference. In one version, the thickness of the first region 165 can range from about 0.3 mm to about 10 mm, and the thickness of the second region 170 can range from about 0.5 mm to about 12 mm. In particular version, the first region 165 can have a thickness selected from 0.38 mm, 0.46 mm, 0.50 mm, and 060 mm, and the second region 170 can have a thickness selected from 1 mm, 1.14 mm, 1.5 mm, 2 mm, and 3 mm. In one version, a set of plectrums 100 can be provided with each plectrum having a different thickness, such as two or more of the thicknesses set forth above, in any combination.

In the version of the plectrum 100 shown in FIGS. 1A though 1C, the plectrum 100 has a plurality of pick tips, such as first pick tip 120 which in the first region 165 and the second pick tip 130 and third pick tip 135 in the second region 170 which the second pick tip 130 and the third pick tip 135 being similar to one another. Alternatively, the second pick tip 130 and the third pick top 135 can be different than one another, such as by having different thicknesses and/or by having different shaped edges and/or by being made from different materials.

Figure 2A:
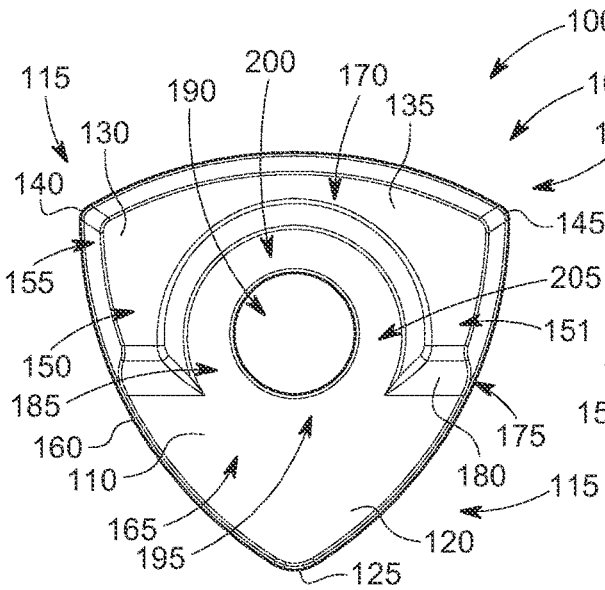
FIG. 2A is a schematic front view of another version of a plectrum according to the invention.
Figure 2B:
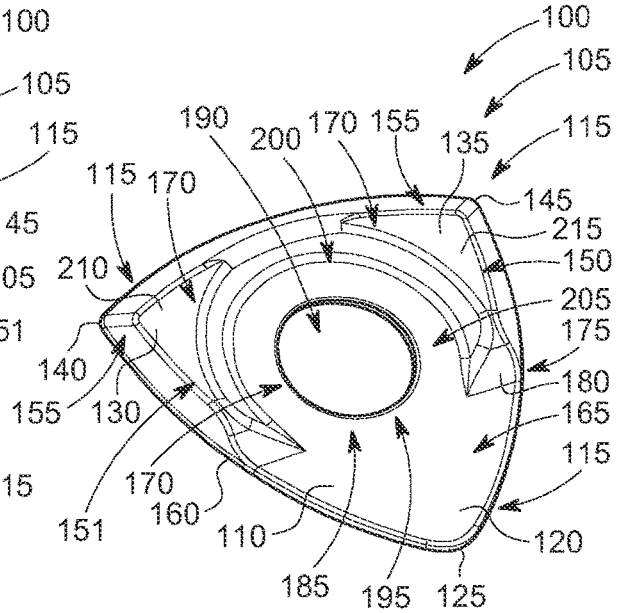
FIG. 2B is a schematic perspective view of the plectrum of FIG. 2A.

FIGS. 2A and 2B show additional versions of a plectrum 100 according to the invention. These versions are similar to the version of FIGS. 1A through 1C. However, in these versions, the central region 185 includes a center portion 200 that is a combination of an opening 190 and a non-open, depressed region 205. In this version, the orientation portion 195 can overlap and include the opening 195 or can include only the non-open, depressed region 205. The version of FIG. 2B further has a divided ergonomic contour 150 that includes a first portion 210 that extends radially towards the second pick tip 130 and a second portion 215 that extends towards the third pick tip 135.

Figure 2C:
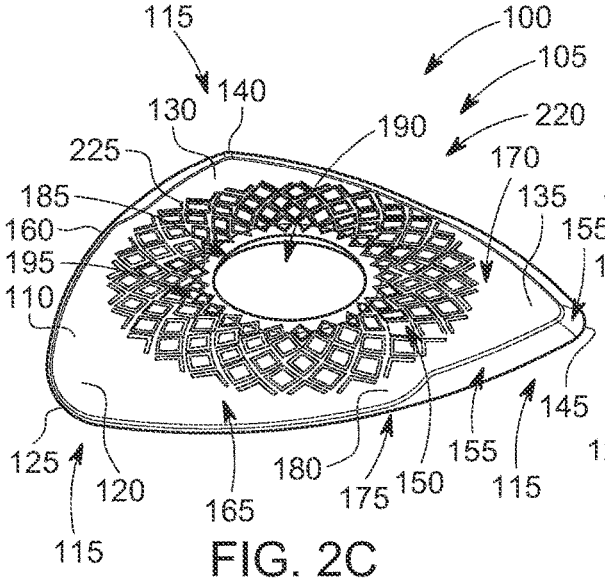
FIG. 2C is a schematic front perspective view of another version of a plectrum according to the invention.
Figure 2D:
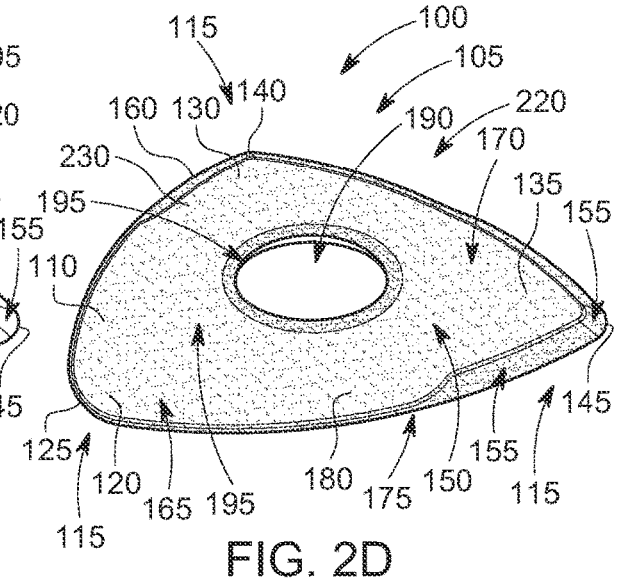
FIG. 2D is a schematic front perspective view of another version of a plectrum according to the invention.

FIGS. 2C and 2D show additional versions of a plectrum 100 according to the invention. These versions are similar to the version of FIGS. 1A through 1C. However, in FIGS. 2C and 2D a texturization 220 is provide on the front face 110 and/or the rear face 111. The texturization 220 can include a series of projections and recessed 225, as shown in FIG. 2C and/or can include a friction-increasing coating or treatment 230 as shown FIG. 2D. The texturization 225 can cover a portion of the front face 110 and/or the rear face 111 or can cover a portion of the front face 110 and/or the rear face 111. The texturization 225 can serve to help a user grip the plectrum 100 and/or relieve stress from the gripping of the plectrum 100. Alternatively, the plectrum 100 can be flat and have no contours.

Figure 3A:
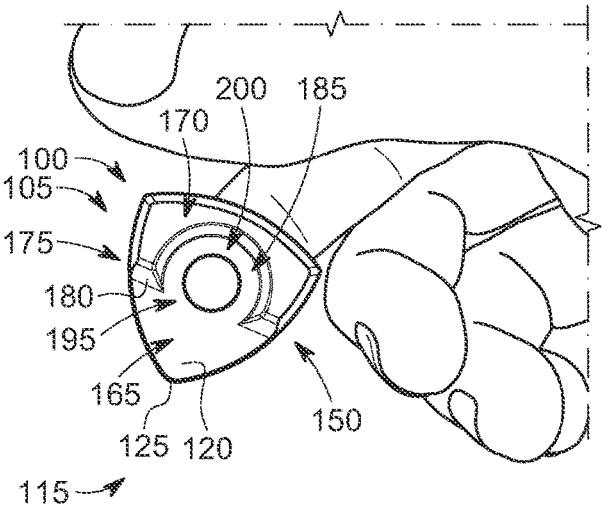
FIG. 3A is a schematic perspective view of a user preparing to grasp the plectrum of FIG. 2A in a first orientation.
Figure 3B:
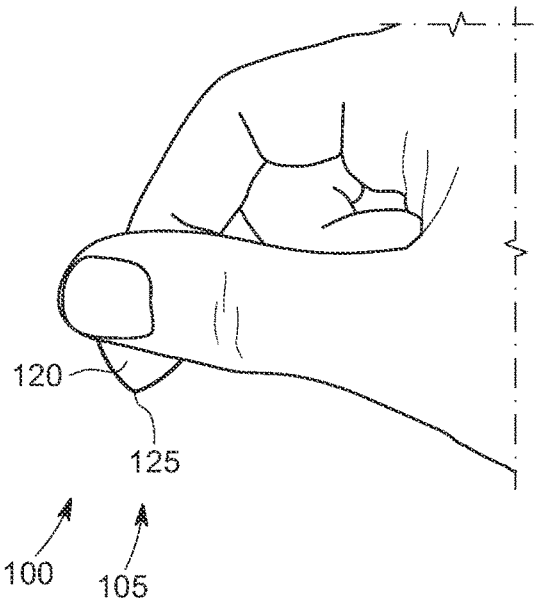
FIG. 3B is a schematic perspective view of a user grasping the plectrum of FIG. 2A in the first orientation.
Figure 3C:
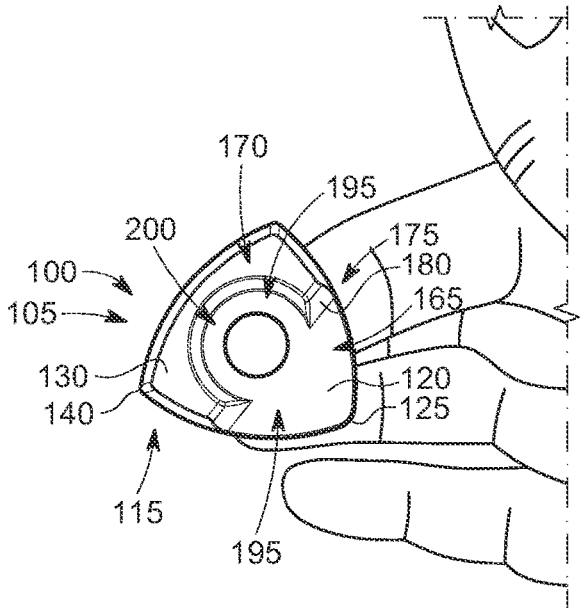
FIG. 3C is a schematic perspective view of a user preparing to grasp the plectrum of FIG. 2A in a second orientation.
Figure 3D:
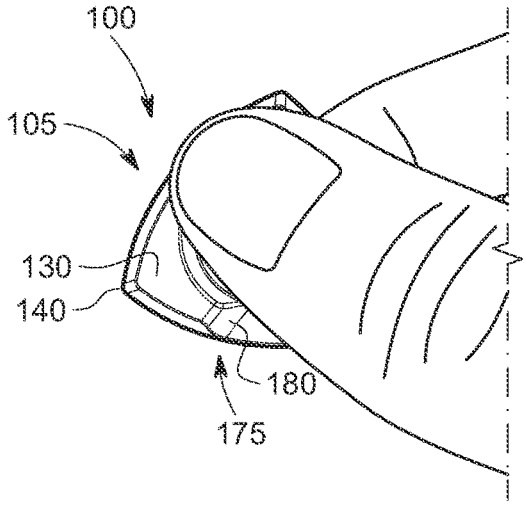
FIG. 3D is a schematic perspective view of a user grasping the plectrum of FIG. 2A in the second orientation.

FIGS. 3A through 3D illustrate different ways in which the plectrum 100 can be held to help the user tactilely understand the orientation of the plectrum. FIG. 3A shows the process of a user starting to grasp the plectrum 100 in a manner that presents the first pick tip 120 for strumming. In FIG. 3B the process of FIG. 3A is completed and the user can feel the orientation portion 195 and thus know the position of the first pick tip 120. In FIGS. 3C and 3D, the user desires to use the second pick tip 130 and holds the plectrum 100 in a manner where the orientation portion 195 tactilely informs the user that the second pick tip 130 is exposed for strumming. These figures are merely examples of ways of holding the plectrum 100. All users have their own unique way of holding a plectrum 100, but no matter the way, the orientation portion 195 can indicate to the user the pick tip or side that is available to strum an instrument.

Figure 4A:
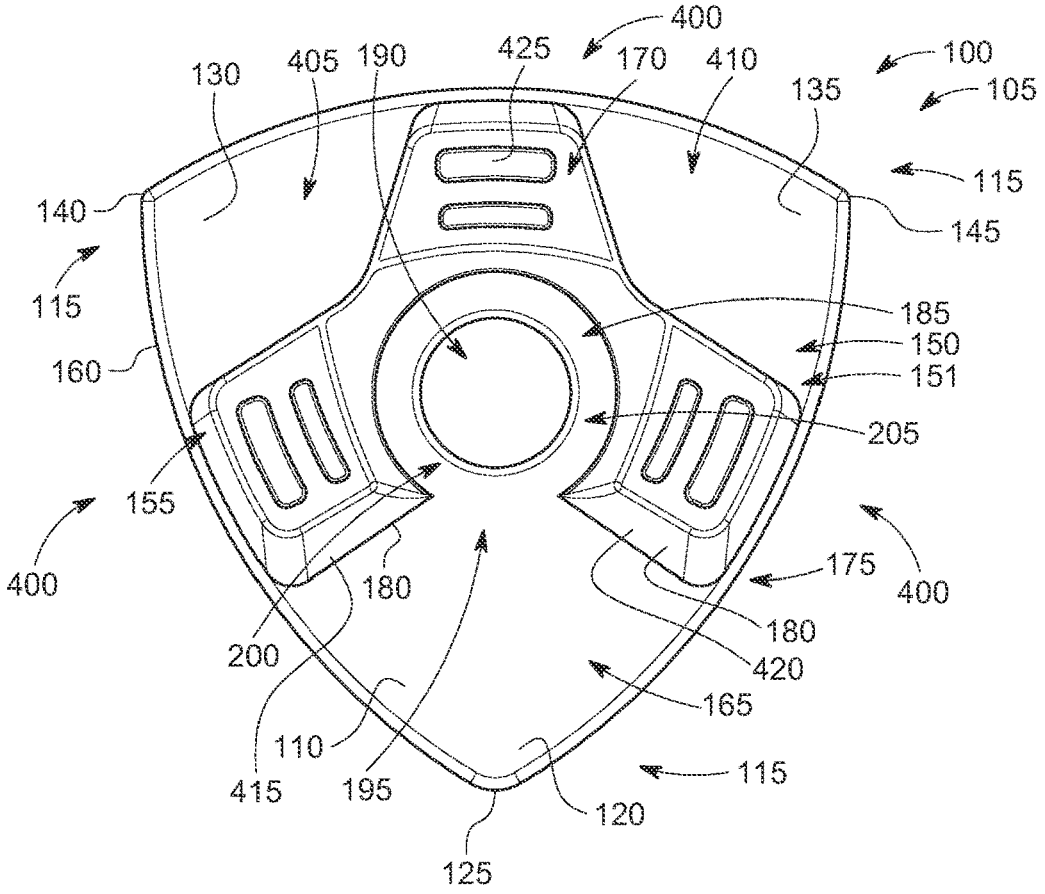
FIG. 4A is a schematic front view of another version of a plectrum according to the invention.
Figure 4B:
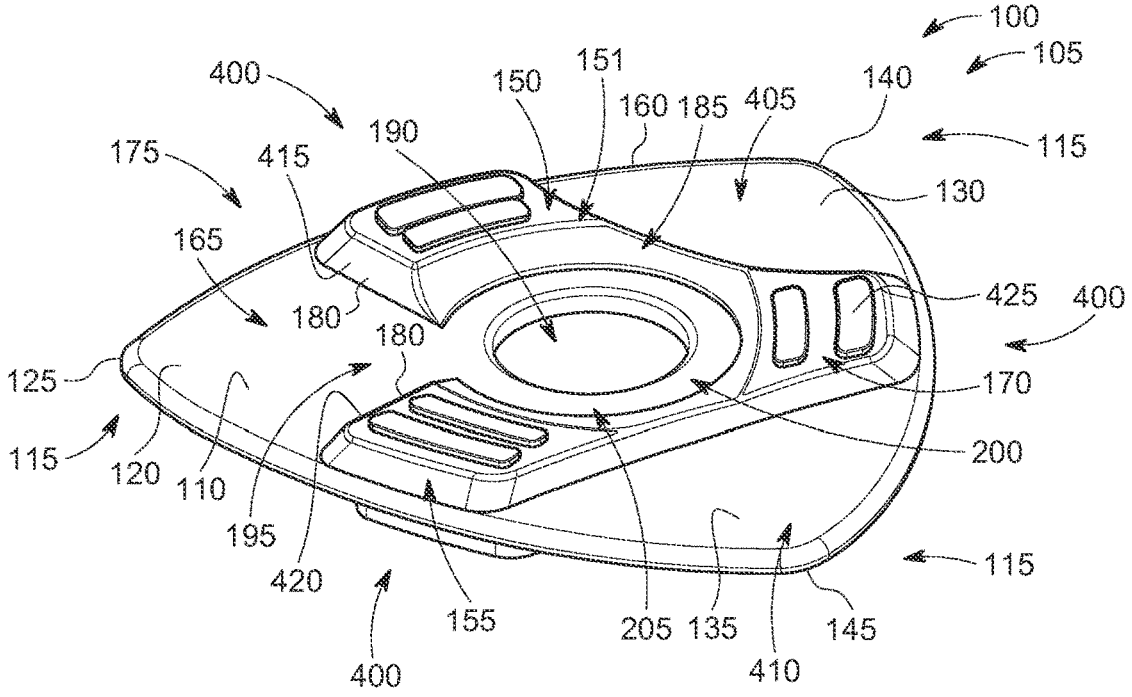
FIG. 4B is a schematic perspective view of the plectrum of FIG. 4A.

FIGS. 4A and 4B show another version of a plectrum 100 of the invention. This version is similar to the versions of FIGS. 1A through 1C and FIGS. 2A and 2B except that in this version, the ergonomic contour 150 includes three radially extending prongs 400 that allow for a reduced thickness 405 second pick tip 130 and a reduced thickness 410 third pick tip 135. As also shown in version of FIGS. 4A and 4B, in contrast to the parallel and/or collinear ridge portions described above, the orientation portion 195 of the central region 185 can be provided by ridge 180 that includes a first ridge 415 and a second ridge 420 that are not parallel but that intersect the central region 185 in a manner that still creates the orientation portion 195 that is orthogonal to the bisector of the first pick tip 120. Also shown in FIGS. 4A and 4B are projections 425 and/or recesses provided on the ergonomic contour 150 to provide additional grip or sensation.

Figure 5A:
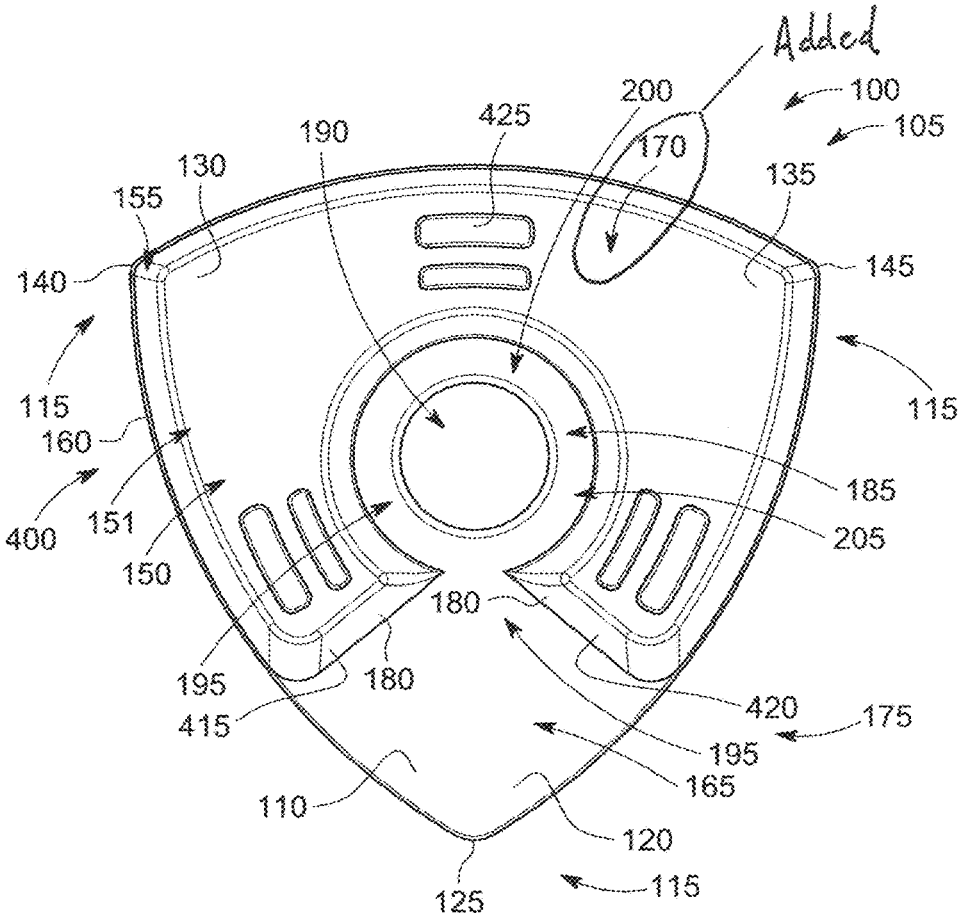
FIG. 5A is a schematic front view of another version of a plectrum according to the invention.
Figure 5B:
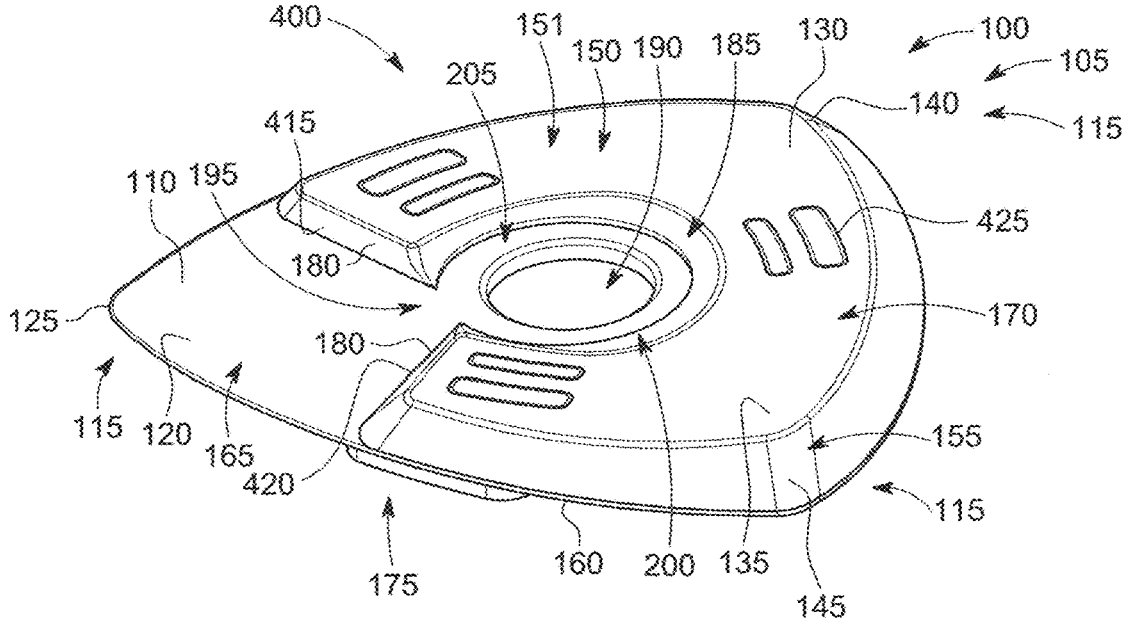
FIG. 5B is a schematic perspective view of the plectrum of FIG. 5A.

FIGS. 5A and 5B show another version of a plectrum 100 of the invention. This version is similar to the versions of FIGS. 4A and 4B but with a single prong 400 and thus without the reduced thickness portions at the second pick tip 130 and third pick tip 135.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number, and all directional limitations, such as up and down and the like, can be switched, reversed, or changed as long as doing so is not prohibited by the language herein with regard to a particular version of the invention. Also, the various features of the versions herein can be combined in various ways to provide additional versions of the present invention. Furthermore, certain terminology has been used for the purposes of descriptive clarity, and not to limit the present invention. Throughout this specification and any claims appended hereto, unless the context makes it clear otherwise, the term "comprise" and its variations such as "comprises" and "comprising" should be understood to imply the inclusion of a stated element, limitation, or step but not the exclusion of any other elements, limitations, or steps. Throughout this specification and any claims appended hereto, unless the context makes it clear otherwise, the term "consisting of" and "consisting essentially of" and their variations such as "consists" should be understood to imply the inclusion of a stated element, limitation, or step and not the exclusion of any other elements, limitations, or steps or any other non-essential elements, limitations, or steps, respectively. Throughout the specification, any discussed on a combination of elements, limitations, or steps should be understood to include a disclosure of additional elements, limitations, or steps and the disclosure of the exclusion of additional elements, limitations, or steps. All numerical values, unless otherwise made clear in the disclosure or prosecution, include either the exact value or approximations in the vicinity of the stated numerical values, such as for example about +/−ten percent or as would be recognized by a person or ordinary skill in the art in the disclosed context. The same is true for the use of the terms such as about, substantially, and the like. Also, for any numerical ranges given, unless otherwise made clear in the disclosure, during prosecution, or by being explicitly set forth in a claim, the ranges include either the exact range or approximations in the vicinity of the values at one or both of the ends of the range. When multiple ranges are provided, the disclosed ranges are intended to include any combinations of ends of the ranges with one another and including zero and infinity as possible ends of the ranges. Therefore, any appended or later filed claims should not be limited to the description of the preferred versions contained herein and should include all such alterations, permutations, and equivalents as fall within the true spirit and scope of the present invention.

What is claimed is:

1. A plectrum for strumming a stringed instrument, the plectrum comprising:

a body having a front face, a rear face, a pick tip, and an outer edge, an ergonomic contour on the front face or the rear face of the body, the ergonomic contour comprising a first region near the pick tip, a second region away from the pick tip, and a ridge between the first region and the second region, wherein the first region has a first thickness and the second region has a second thickness larger than the first thickness, and wherein the ridge transitions from the second thickness to the first thickness and extends substantially along a line orthogonal to a line bisecting the pick tip, and extends outward to a position short of the outer edge of the plectrum, wherein the ergonomic contour creates a surface that is contactable by a thumb or other finger of a user to provide a tactile indication of the position of the pick tip to assist the user in using the plectrum and wherein the ergonomic contour does not interfere with using the outer edge during strumming.

2. A plectrum according to claim 1 wherein the pick tip is a first pick tip and where the body comprises a second pick tip, and a third pick tip, and wherein the second pick tip and the third pick tip are in the second region.

3. A plectrum according to claim 2 wherein the first pick tip is different than the second and third pick tip.

4. A plectrum according to claim 1 wherein the ridge intersects a central region of the body.

5. A plectrum according to claim 4 wherein the intersection of the ridge and the central region creates a depression in the ridge that is aligned with the pick tip.

6. A plectrum according to claim 1 wherein the ridge comprises a first ridge portion and a second ridge portion, wherein the first ridge portion and the second ridge portion intersect a central region of the body to create an orientation portion in the central region, and wherein the orientation portion is aligned with the pick tip.

7. A plectrum for strumming a stringed instrument, the plectrum comprising:

a body having a front face, a rear face, a central region, a first pick tip, a second pick tip, and a third pick tip, an ergonomic contour on the front face or the rear face of the body, the ergonomic contour comprising a first region that includes the first pick tip, a second region that includes the second pick tip and the third pick tip, and a ridge between the first region and the second region, wherein the first region has a first thickness and the second region has a second thickness larger than the first thickness, wherein the ridge transitions from the second thickness to the first thickness, and wherein the ridge intersects the central region and the intersection creates a depression in the ridge that is aligned with the first pick tip creating a surface that is contactable by a thumb or other finger of a user to assist the user in using the plectrum and providing a tactile indication of the location of the first pick tip.

8. A plectrum according to claim 7 wherein the ridge terminates short of an outer edge of the body.

9. A plectrum for strumming a stringed instrument, the plectrum comprising:

a body having a front face, a rear face, a central region, a first pick tip, a second pick tip, and a third pick tip, wherein the central region comprises a region surrounding the center of the body and extending away from the center of the body toward the first pick tip, the second pick tip, and the third pick tip, an ergonomic contour on the front face or the rear face of the body, the ergonomic contour comprising a first region that includes the first pick tip and a second region that includes the second pick tip and the third pick tip, wherein the first region has a first thickness and the second region has a second thickness larger than the first thickness, wherein the central region has a non-uniform thickness around its periphery that includes a portion in the first region and a portion in the second region, and wherein the portion of the central region in the first region creates an orientation portion that is aligned with the first pick tip creating a surface that is contactable by a thumb or other finger of a user to assist the user in using the plectrum and providing a tactile indication of the location of the first pick tip.

10. A plectrum according to claim 1 wherein the ridge extends radially from a central region to a position short of the outer edge of the plectrum.

11. A plectrum according to claim 7 wherein the ridge comprises a first ridge portion and a second ridge portion, wherein the first ridge portion and the second ridge portion are separated by the depression.

12. A plectrum according to claim 7 wherein the depression has a thickness substantially the same as the first region.

13. A plectrum according to claim 7 wherein the ridge extends substantially orthogonal to a line bisecting the first pick tip.

14. A plectrum according to claim 13 wherein the ridge extends substantially along a line.

15. A plectrum according to claim 9 wherein the orientation portion extends around the central region for a radial distance of less than 180 degrees.

16. A plectrum according to claim 9 wherein the orientation portion has a thickness substantially the same as the thickness of the first region.

17. A plectrum according to claim 9 wherein the body comprises a ridge between the first region and the second region, wherein the ridge transitions from the second thickness to the first thickness, and wherein the ridge intersects the central region and the intersection creates a depression in the ridge becomes the orientation portion.

18. A plectrum according to claim 17 wherein the ridge extends orthogonal to a line bisecting the first pick tip.

19. A plectrum according to claim 18 wherein the ridge extends along a line.

20. A plectrum according to claim 9 wherein the central region comprises an opening that extends through the body.

* * * * *